United States Patent [19]

Salabe et al.

[11] Patent Number: 4,919,437

[45] Date of Patent: Apr. 24, 1990

[54] SELF-REGENERATION BALLISTIC PROJECTILE-ARRESTER

[75] Inventors: Mario Salabe; Adelio Rossi, both of Rome, Italy

[73] Assignee: Impresa Costruzioni Soc. Fra.Sa. a r.l., Rome, Italy

[21] Appl. No.: 279,893

[22] Filed: Dec. 5, 1988

[30] Foreign Application Priority Data

Dec. 3, 1987 [IT] Italy ..... 48670 A/87

[51] Int. Cl.[5] ..... F14J 1/12; G01L 5/14

[52] U.S. Cl. ..... 273/410; 73/167

[58] Field of Search ..... 73/167; 273/410

[56] References Cited

U.S. PATENT DOCUMENTS 2,411,026 11/1946 Conner et al. ..... 73/167 X
2,813,422 11/1957 Schuessler ..... 73/167
4,728,109 3/1988 Simonetti ..... 273/410
4,786,059 11/1988 Barini ..... 73/167 X

*Primary Examiner*—Daniel M. Yasich
*Attorney, Agent, or Firm*—Pollock, Vande Sande & Priddy

[57] ABSTRACT

A self-regeneration ballistic projectile-arrester, suitable for small arms indoor firing ranges comprises granulated material in form of a heap, to absorb the kinetic energy of the fired projectiles. A pair of belts moving in opposite and converging directions, and being inclinable with respect to the firing plane and being spaced from and opposite to one another, are arranged as supports at the bottom of the material heap with their longitudinal axis parallel to the firing axis, for conveying the material towards a zone where it is separated from the exploded projectiles. The regenerated material is then carried onto the top of the heap for recycling.

11 Claims, 1 Drawing Sheet

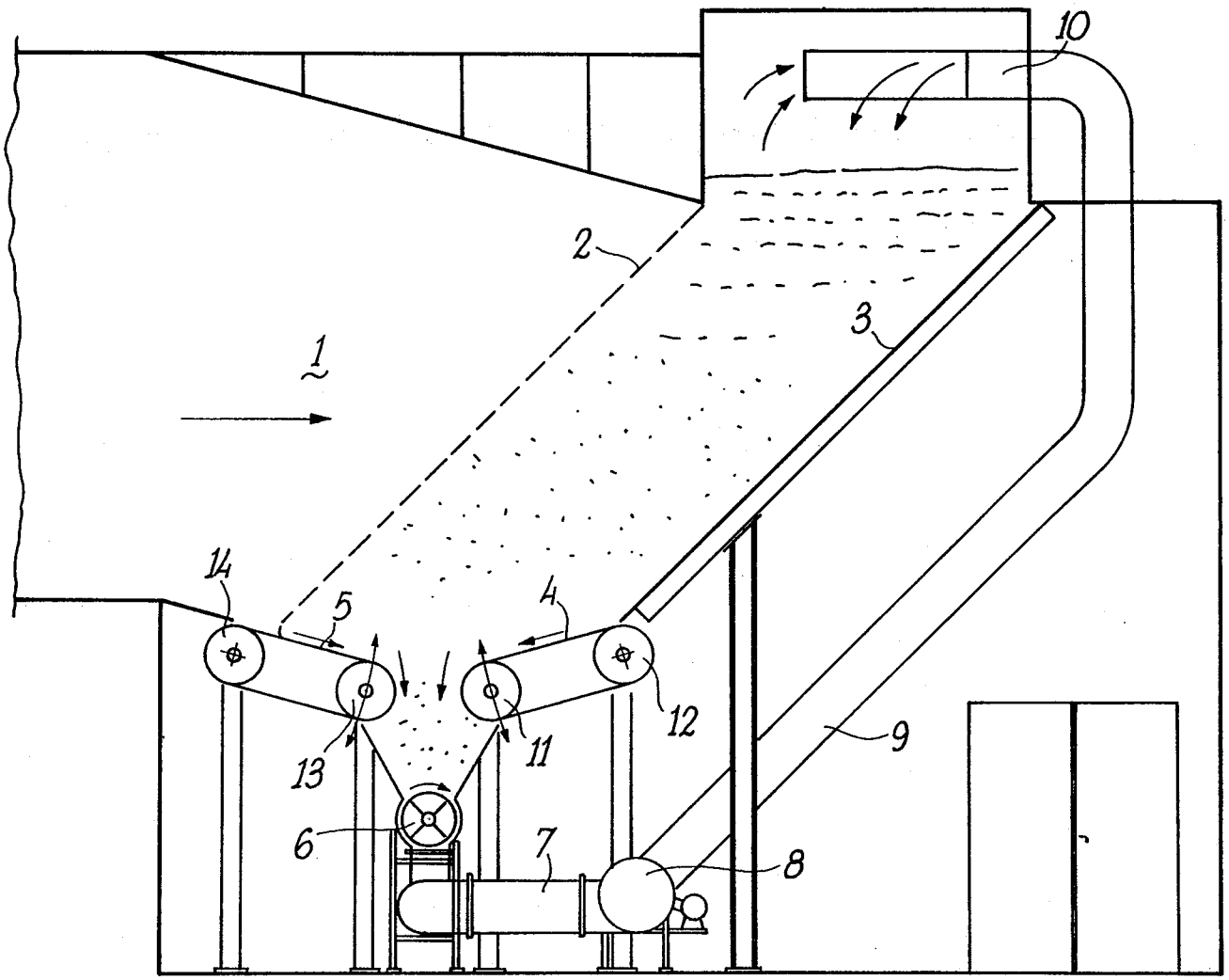
10
3
9
8
12
2
4
11
7
1
5
13
6
14

SELF-REGENERATION BALLISTIC PROJECTILE-ARRESTER

FIELD OF THE INVENTION

The present invention relates to a self-regeneration ballistic projectile-arrester suitable for small arms firing, in particular at indoor firing ranges.

More particularly, this invention relates to a projectile-arrester of the type mentioned above, the improvement consisting in the structural and conceptual modification of the mechanical conveyance of the granulated material together with exploded projectiles which have become embedded therein towards the proper regeneration and recovery zone.

BACKGROUND OF THE INVENTION

A number of different structures have been employed up to the present time as ballistic projectile-arresters, e.g., wood stacks, piles of tires, heaps of sand and the like, all such structures having defects or drawbacks relating both to their safety of employment and their practicality.

Other known types of projectile-arresters are made up of metallic plates that convey projectiles into chambers after slowing down the same as a result of their geometrical features, said chambers serving the purpose of dissipating the kinetic energy.

Projectile-arresters of such kind give rise to a large production of splinters, fragments, dust and lead vapors.

U.S. Pat. No. 2,411,026 contains a first teaching for the realization of projectile-arresters employing a granulated impact material and a recovery/regeneration system of the material itself.

More recently, applicant has developed the basic solution of the above-mentioned patent, and has been successful in realizing a self-regeneration ballistic projectile-arrester which eliminates all drawbacks of the latter.

The ballistic projectile-arrester is the subject of U.S. Pat. No. 4,728,109.

SUMMARY OF THE INVENTION

Applicant has now studied a further solution to the problem, which solution, exploiting the basic technical teachings already disclosed and claimed in the patent applications mentioned above, allows a ballistic projectile-arrester to be obtained which has means for supporting and conveying granulated material and projectiles and which is so modified structurally as to avoid the occurrence, in some cases, of blocks in the flow of the material itself down toward the separation means.

Such objects are obtained according to the present invention, by arranging two slanting conveyor belts, moving in opposite converging directions, at the bottom or base of the heap of granulated material and projectiles, said belts causing the material itself to move in a direction parallel to the firing direction.

Accordingly, a specific object of the present invention is a self-regeneration ballistic projectile-arrester, suitable for firing with small arms and other types of arms, in particular at indoor firing ranges, said projectile-arrester comprising a heap of granulated material for taking up the kinetic energy of the projectiles. The installation further comprises means for conveying and carrying the material towards the separation zone, means for separating the material from exploded projectiles; and means for delivering the regenerated material onto the top of said heap. The means for supporting the material heap and for conveying the material towards said transportation means comprises two belts moving in opposite and converging directions and sloped and/or inclinable with respect to the firing plane, said belts being arranged opposite one another and spaced from one another at the bottom of the material heap with their longitudinal axes parallel to the firing axis.

According to a preferred embodiment of the projectile-arrester of the present invention, the speed of rotation of the two belts can be adjusted independently of each other, said belts in addition being at a slope that can be variously adjusted with respect to the firing plane, from 0°, corresponding to the position in which the two belts block the flow of the material towards the transportation means up to the separation zone, to a slope less that 90°.

Each of said two belts can comprise two toothed wheels, one of them being idle, and each belt can be a continuous belt consisting of metallic restrained staves.

A roll can be provided instead of one of said pairs of toothed wheels.

Preferably, the means for conveying and carrying the material towards the separation zone may comprise a wheel bearing a number blades or vanes, as well as of a conveyor belt, or they may comprise two wheels bearing blades or vanes, whereas the separation means comprise a fan.

Obviously, a number of projectile-arresters according to the present invention may be arranged side by side, with the provision of separate conveyor and transportation means for carrying the material towards the separation zone.

Alternatively, the two belts can also be separate for each individual projectile-arrester, or they may be realized as a single belt. In that case, a separation baffle must be provided between the adjacent belts to convey the material mass towards the two sides which are served by separate conveyance and transportation means.

BRIEF DESCRIPTION OF THE DRAWINGS

The present invention will now be described with reference to the attached drawing, showing, by way of example, a side view of a particular embodiment of the projectile-arrester according to the present invention.

DESCRIPTION OF THE PREFERRED EMBODIMENT

The heap 2 of granulated material is placed at the end of the indoor firing ground 1, the exploded projectiles dissipating their kinetic energy in said heap.

A ballistic screen 3 is arranged behind heap 2.

The material 2 rests on two belts 4 and 5, moving in opposite and converging directions, and pushing the material from the heap 2 towards the receiving-delivering device 6.

The material is conveyed towards the conduit or pipe 7 from said receiving-delivering device 6, which consists of rotating blades or vanes.

The fan 8 pushes the material along the conduit or pipe 9 towards the orifice 10 for returning the material again to the heap, while the heavier projectiles are separated out and remain at the bottom of the device due to the force of gravity.

Each of the two belts 4 and 5 comprises two toothed wheels 11,12 and 13,14, one of said wheels being a driving wheel (11, 13) whereas the other one (12, 14) is idle.

The belts 4 and 5 are provided with metallic restrained staves that allow a suitable tightness to be obtained.

One of the two pairs of wheels 11,12 or 13,14 may be replaced by a single roll.

The speed of rotation of each of the two belts 4 and 5 may be changed independently of that of the other belt through sensing means (not shown).

The slope of the two belts 4 and 5 may also be changed through sensing means (not shown) so as to modify the distance between the outer edges, and consequently the passage section of the material, possibly to the point of the complete closure of such section.

The projectile-arrester shown in the drawing is modular so that a plurality of projectile-arresters according to the invention can be assembled side by side so as to meet any requirement.

When a number of projectile-arresters are assembled side by side, the individual receiving-delivering devices 6 will be separate from one another, though they will be very close to each other, while the belts 4 and 5 can also be continuous.

However, if modular belts 4 and 5 are employed in a way similar to that for the receiving-delivering devices 6, a two-face separating baffle will be necessary in order to convey the overhanging heap 2 towards the two sides served by the different receiving-delivering devices 6.

The particular structural configuration of the belts 4 and 5, as well as the possibility of adjusting the speed and the slope of the same, allows an optimal flow of the material to be obtained down towards the regeneration step, so that any possible clogging is avoided.

We claim:

1. A self-regeneration ballistic porjectile-arrester comprising a heap (2) of granulated material for taking up the kinetic energy of projectiles and a regeneration/-recovery system for said granular material, comprising (a) a plurality of means (6) for conveying said material towards a separation zone (7);

(b) means for separating said material from exploded projectiles embedded therein; and (c) means (8, 9) for delivering said granular material, separated from said projectiles, above said heap;

(d) said projectile-arrester comprising two belts (4, 5) moving in opposite and converging directions for supporting said heap and for conveying said material form the heap towards said conveying means (6), said belts being inclinable with respect to a firing plane of said projectiles and being spaced and opposite to one another under said heap, with their longitudinal axes parallel to a firing axis.

2. A ballistic projectile-arrester according to claim 1, wherein the speeds of rotation of said two belts are adjustable independently of one another.

3. A ballistic projectile-arrester according to claim 1, wherein the slopes of said two belts are adjustable independently of one another with respect to said firing plane, from an angle of 0°, at which position the two belts block the passage for the flow of the material towards the conveying means down to the separation zone, to a slope having an angle less than 90°.

4. A ballistic projectile-arrester according to any one of claims 1 to 3, wherein each one of said two belts comprises two toothed wheels one of which is idle.

5. A ballistic projectile-arrester according to any one of claims 1 to 4, wherein said two belts comprise a continuous belt consisting of metallic restrained staves.

6. A ballistic projectile-arrester according to any one of claims 1 to 4, wherein one of said two belts comprises two toothed wheels, and the other of said two belts comprises a roll.

7. A ballistic projectile-arrester according to any one of claims 1 to 4, wherein said means for conveying the material towards the separation zone comprise a wheel provided with vanes and a conveyor belt.

8. A ballistic projectile-arrester according to any one of claims 1 to 4, wherein said means for conveying the material towards the separation zone comprises two wheels provided with vanes and a conveyor belt.

9. A ballistic projectile-arrester according to any one of claims 1 to 4, comprising a fan for pushing said material along a conduit to a position above said heap.

10. A ballistic projectile-arrester according to any one of claims 1 to 4, wherein said two belts of each unit are in the form of a single belt.

11. A ballistic projector arrester according to any one of claims 1 to 4, wherein said two belts of each unit are separate from the belts of the other units.

* * * * *